US005885014A

United States Patent [19]

Small et al.

[11] Patent Number: 5,885,014

[45] Date of Patent: Mar. 23, 1999

[54] PRINTER DEFINING A REDUCED EXTERIOR ENVELOPE THEREOF AND METHOD OF PROVIDING SAME

[75] Inventors: Jeffrey A. Small, Rochester; James E. Elly, North Chili, both of N.Y.

[73] Assignee: Eastman Kodak Company, Rochester, N.Y.

[21] Appl. No.: 946,317

[22] Filed: Oct. 7, 1997

[51] Int. Cl.[6] ..... B41J 35/28

[52] U.S. Cl. ..... 400/208; 400/242

[58] Field of Search ..... 400/208, 208.1, 400/242, 207, 196

[56] References Cited

U.S. PATENT DOCUMENTS

| | | | |
|---|---|---|---|
| 3,195,828 | 7/1965 | Kuckoff et al. | 400/242 |
| 4,265,553 | 5/1981 | Hatsell | 400/208 |
| 4,854,755 | 8/1989 | Lange et al. | 400/208 |
| 5,005,998 | 4/1991 | Takanashi et al. . | |
| 5,277,502 | 1/1994 | Kim | 400/208 |
| 5,597,249 | 1/1997 | Mistyurik . | |

OTHER PUBLICATIONS

Belave et al., "Printer Defining a Reduced Exterior Envelope Thereof and Method of Providing Same", USSN 08/944,348 (Attorney Docket No. 76546), filed Oct. 6, 1997.

Siwinski, "Printer Defining a Reduced Exterior Envelope Thereof and Method of Providing Same", USSN 08/938915 (Attorney Docket No. 76602), filed Sep. 26, 1997.

Siwinski, "Dye Cartridge Adapted to Reduce an Exterior Envelope of a Printer and Method of Providing Same", USSN 08/235865, (Attorney Docket No. 76607), filed Sep. 26, 1997.

Small et al., "Dye Cartridge System Adapted to Reduce an Exterior Envelope of a Printer and Method of Providing Same", USSN 08/946911, (Attorney Docket No. 76683), filed Oct. 1, 1997.

*Primary Examiner*—Eugene Eickholt

*Attorney, Agent, or Firm*—Walter S. Stevens

[57] ABSTRACT

Printer defining a reduced exterior envelope thereof and method of providing same. The printer comprises a housing having a front sidewall that has an aperture therethrough. A platen, a print head and a take-up spool are disposed in the housing. In one embodiment of the invention, the print head is movable from a first position spaced-apart from the platen to a second position adjacent to the platen, such that the platen and the print head define a clearance therebetween when the print head is in the first position. A dye donor cartridge, which has an elongate neck portion, is insertable through the aperture and into the housing to a position adjacent to the print head. The neck portion is sized to be received through the clearance for interference-free insertion of the cartridge. Moreover, the cartridge includes a dye donor supply spool. The take-up spool disposed in the housing allows the neck portion to be inserted through the clearance so that the neck portion does not create an interference with the print head. In this manner, the cartridge may be loaded through the aperture in the front sidewall rather than by opening a top panel of the printer, so that the exterior envelope of the printer is reduced. This allows the printer to reside in a confined space with limited headroom.

22 Claims, 4 Drawing Sheets

PRINTER DEFINING A REDUCED EXTERIOR ENVELOPE THEREOF AND METHOD OF PROVIDING SAME

FIELD OF THE INVENTION

This invention generally relates to printer apparatus and methods and more particularly relates to a printer defining a reduced exterior envelope thereof and method of providing same.

BACKGROUND OF THE INVENTION

A typical thermal printer has an enclosure for enclosing the components of the printer. Receiver medium is held in a supply tray at least partially insertable into the enclosure for supplying the receiver medium to a print head housed in the enclosure. A "picker" mechanism engages the receiver medium held in the supply tray and feeds the receiver medium to the print head. The receiver medium fed to the print head is brought into contact with a dye donor web carried by a dye donor cassette also insertable into the enclosure, the cassette capable of being disposed near the print head. The print head heat activates the dye donor web to transfer the dye to the receiver medium in order to print an output image on the receiver medium. The enclosure and the supply tray define an exterior envelope of the printer.

The dye donor cassette is usually inserted into the printer by opening a top panel of the printer and lowering the dye donor cassette into position in the printer. However, such printers are often placed in a confined space with limited head room. For example, such printers are often placed on shelves, wherein the floor of an adjacent upper shelf forms a relatively low ceiling above the top panel of the printer. Thus, this ceiling creates an interference or obstruction to opening the top panel. This makes loading the dye donor cassette difficult and time-consuming because the printer first must be removed from the shelf in order to open the top panel before loading the dye donor cassette into the printer. Therefore, it would be desirable to provide a printer obviating the need to open the top panel in order to load the dye donor cassette.

Front loading printers are known. A compact printer body capable of accepting an ink film and printing papers device into a receiving hole provided at the front face of the printer body is disclosed in U.S. Pat. No. 5,277,502 titled "Device For Loading Ink Film And Printing Papers In Color Video Printer" issued Jan. 11, 1994 in the name of Jae S. Kim. More specifically, this patent discloses a device having combined ink film and printing papers therein for combined loading of the ink film and printing papers into the color video printer. According to this patent, the device achieves a reduced size and thus results in compactness of the printer body. However, this combined ink film and printing papers device does not appear suitable for use where it is desired to feed printing papers and ink film independently and separately into the printer.

Therefore, there has been a long-felt need to provide a suitable printer that obviates the need to load the dye donor cartridge by opening the top panel of the printer.

SUMMARY OF THE INVENTION

The invention resides in a printer comprising a first image forming member and a second image forming member associated with the first image forming member. The second image forming member is movable from a first position spaced-apart from the first image forming member to a second position adjacent to the first image forming member. In addition, the first image forming member and the second image forming member define a clearance therebetween as the second image forming member is in the first position. A cartridge to be inserted into the housing has an elongate neck portion sized to be received through the clearance for interference-free insertion of the cartridge into said housing. The cartridge has a dye ribbon disposed therein. The dye ribbon has an end portion and a catch-member attached to the end portion of the dye ribbon. Associated with the catch-member is a spool having a recess therein for receiving the catch-member.

A dye donor cartridge is insertable through the aperture and into the housing to a position adjacent to the print head. The cartridge has an elongate neck portion sized to be received through the clearance for interference-free insertion of the cartridge between the print head and the platen. Moreover, the cartridge includes a supply spool at one end of the cartridge for engaging a first end portion of a dye donor ribbon carried by the cartridge. The dye donor ribbon extends through the neck portion. A take-up spool is disposed in the housing for engaging a second end portion of the dye donor ribbon. In this manner, the cartridge can be loaded through the aperture in the front sidewall rather than by opening a top panel of the printer, so that the exterior envelope of the printer is reduced. In other words, the cartridge can be loaded through the aperture in the front sidewall rather than by opening a top panel, so that clearance required above the printer in order to access the printer is reduced. This allows the printer to reside in a confined space with limited headroom.

An object of the present invention is to provide a printer defining a reduced exterior envelope thereof.

A feature of the present invention is the provision of a print head disposed in a housing having a front sidewall having an aperture, the print head being movable from a first position spaced-apart from the platen to a second position adjacent to the platen, the platen and the print head defining a clearance therebetween when the print head is in the first position.

An advantage of the present invention is that the printer has a reduced exterior envelope, with a reduced clearance above the printer, resulting from the cartridge being loaded through the aperture in the front sidewall rather than by means of opening a top panel of the printer in order that the printer may reside in a confined space with limited headroom.

These and other objects, features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

The present invention is directed in particular to elements forming part of, or cooperating more directly with, apparatus in accordance with the present invention. It is to be understood that elements not specifically shown or described may take various forms well known to those skilled in the art.

Figure 1:
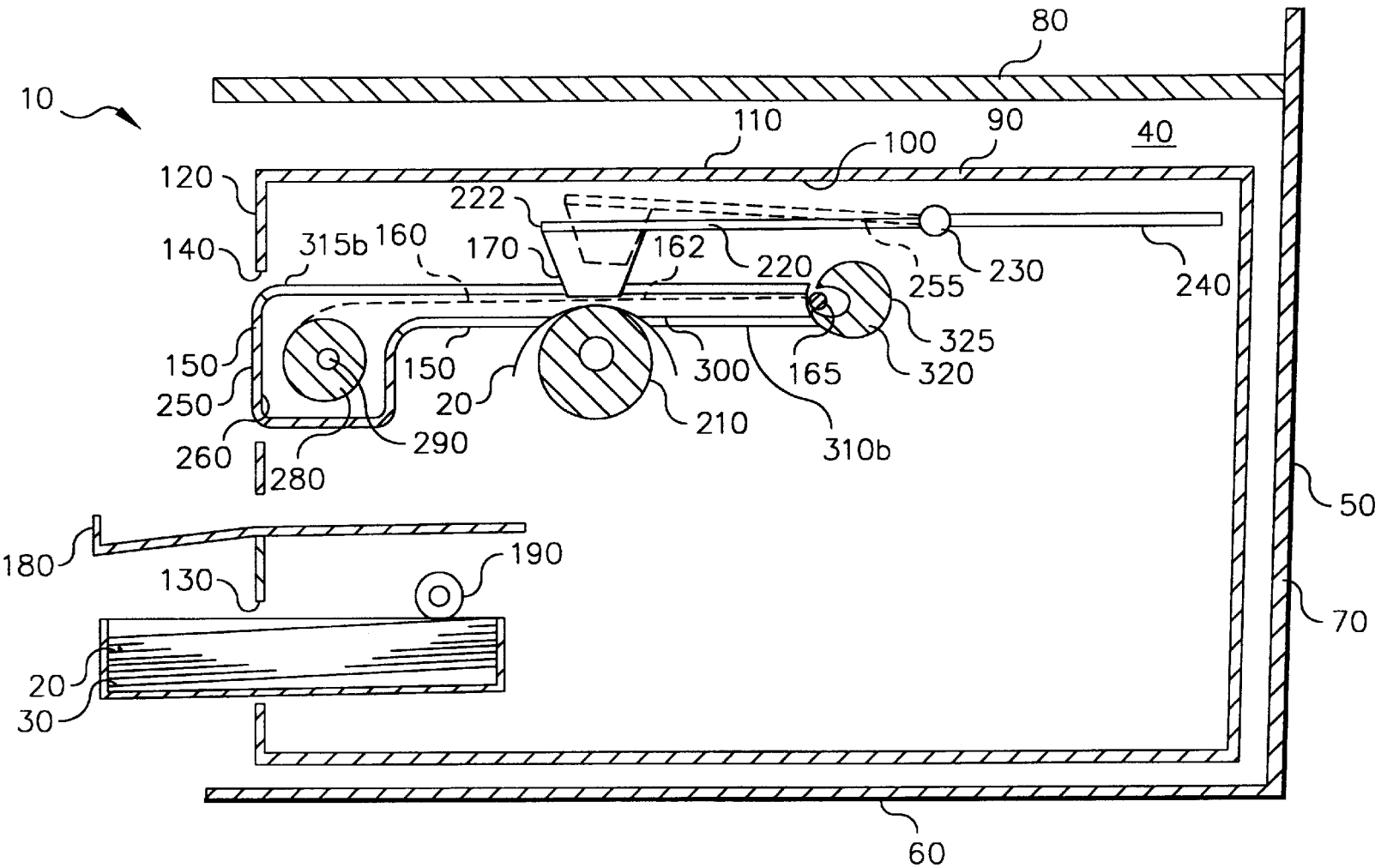
FIG. 1 is a view in elevation of a first embodiment thermal printer with parts removed for clarity, the printer having a housing defining a reduced exterior envelope thereof for disposing the printer in a confined space with limited headroom, this view also showing a cartridge carrying a dye donor ribbon and after insertion into the printer while the print head is in a first position spaced-apart from a platen disposed in the housing.

Therefore, referring to FIG. 1, there is shown a first embodiment of a printer, such as a thermal resistive printer, generally referred to as 10, for printing an image on a dye receiver 20, which receiver 20 may be a roll of receiver or a plurality of cut sheets of coated paper or transparency fed from a receiver medium supply tray 30. As described more fully hereinbelow, printer 10 has a reduced exterior envelope so that printer 10 may be placed in a confined space 40, such as defined by a shelf structure 50 bounded by a floor 60, a rear wall 70 and a relatively low ceiling 80 overhanging printer 10.

Referring again to FIG. 1, printer 10 comprises a housing 90 defining an exterior envelope thereabout and an interior 100 therein. Housing 90 includes a top wall 110 and a front sidewall 120, front sidewall 120 having an opening 130 sized to receive supply tray 30 which is at least partially insertable through opening 130. Also formed through front sidewall 120 is an aperture 140 for receiving a dye-carrying dye donor supply cartridge 150. In this regard, cartridge 150 carries a thermally activatable dye donor ribbon 160 having an end portion 162. Dye donor ribbon includes a catch member, such as an elongate pin 165, extending along end portion 162 for reasons disclosed hereinbelow. Moreover, disposed in housing 90 is a thermal resistive print head 170 for thermally activating dye donor ribbon 160 in order to transfer dye therein onto each of sheets 20. In this regard, thermal print head 170 is formed of a plurality of individual resistive heating elements (not shown) such that when a particular heating element is energized, its heat causes dye from dye donor ribbon 160 to transfer to sheet 20 for forming an image thereon. Printer 10 also includes an output tray assembly 180 for receiving sheets 20 after the image is formed on each sheet 20. Moreover, a picker roller 190 is disposed in housing 90 for separately urging each sheet 20 into a gap or nip area 200 (see FIG. 2) defined between print head 170 and a platen 210, which platen 210 is also disposed in housing 90.

Figure 2:
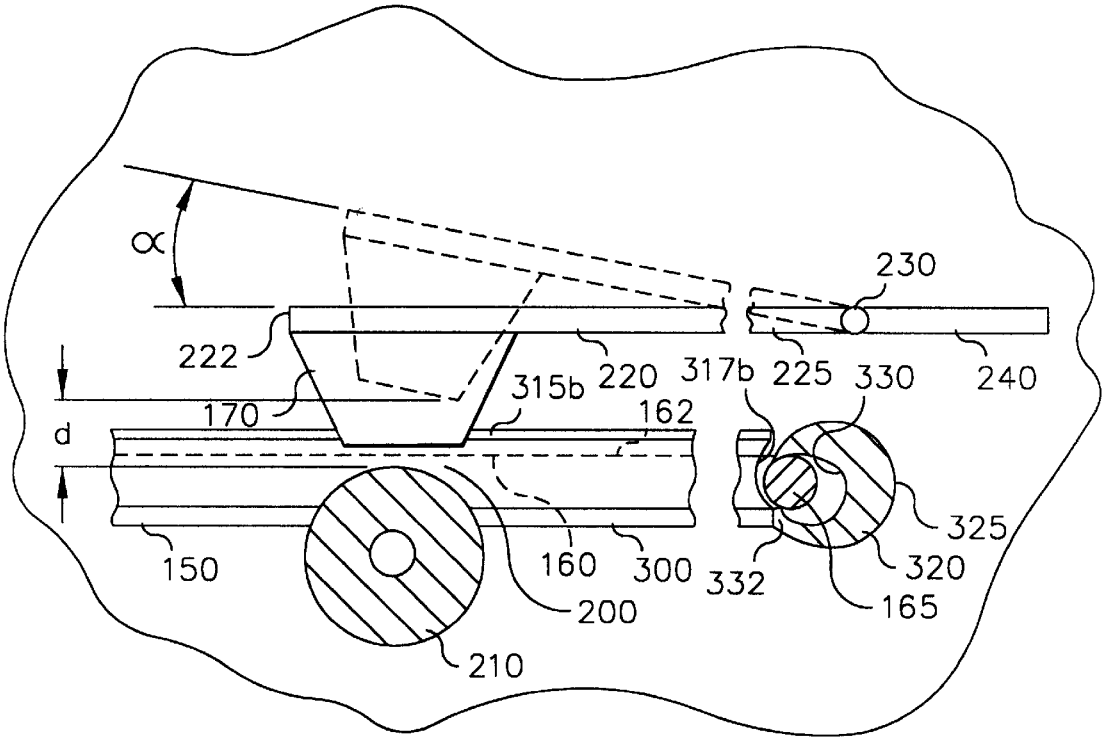
FIG. 2 is a fragmentation view in elevation of the printer showing a print head and the platen belonging to the printer, the print head being movable from the first position to a second position adjacent to the platen.

Referring to FIGS. 1 and 2, printer 10 further comprises a movable arm 220 having a first end portion 222 connected to print head 170 and a second end portion 225 connected to a joint 230 interconnecting arm 220 to a stationary support member 240. Arm 220 is capable of pivoting about joint 230 through a predetermined angle "α" of approximately 10 degrees entirely within housing 90. As arm 220 pivots about joint 230, print head 170 moves from a first position spaced-apart from platen 210 to second position adjacent to platen 210. In this regard, when print head 170 is in the first position thereof, print head 170 defines a clearance "d" between print head 170 and platen 210. Of course, this clearance "d" is substantially reduced when print head 170 moves to the second position thereof.

Referring now to FIGS. 2, 3, 4 and 5, cartridge 150, which is insertable through aperture 140 of front sidewall 120, includes an enlarged end portion 250 defining a chamber 260 therein in communication with an opening 270, for reasons disclosed hereinbelow. Disposed in chamber 260 is a cylindrical supply spool 280 surrounding a first axle 290 centered longitudinally through supply spool 280, which first axle 290 in turn is connected to a first motor (not shown) for rotating axle 290. Thus, supply spool 280 rotates as axle 290 rotates. Cartridge 150 further comprises an elongate neck portion 300 formed by a pair of spaced-apart parallel tines 310*a* and 310*b*, each tine 310*a*/310*b* having a first end portion 315*a* and 315*b*, respectively, integrally attached to enlarged portion 250.

Referring again to FIGS. 2, 3, 4 and 5, disposed in housing 90 is a take-up spool 320 having an exterior surface 325 and also having a recess 330 therein of predetermined contour. An arcuate-shaped protuberance portion 332 may be integrally attached to take-up spool 320 and oriented such that it engages pin 165 when take-up spool 320 is rotated by a second motor (not shown) in one direction and disengages pin 165 when take-up spool 320 is rotated in the opposite direction. Thus, the purpose of protuberance 332 is to assist capture of pin 165 into recess 330 while not interfering with release of pin 165 from recess 330, when desired. Recess 330 may be formed longitudinally along cylindrical take-up spool 320. Alternatively, recess 330 may be formed in a pair of flanges (not shown) surrounding respective end portions of take-up spool 320. As previously mentioned, dye donor cartridge 150 carries thermally activatable dye donor ribbon 160. Therefore, it may be appreciated that a first end portion of dye donor ribbon 160 is necessarily attached to supply spool 280 and a second end portion of dye donor ribbon 160 is necessarily attached to take-up spool 320. Thus, the dye donor ribbon 160 is initially substantially wound about supply spool 280 and is subsequently unwound therefrom onto take-up spool 320 as the first and second motors operate.

Figure 4:
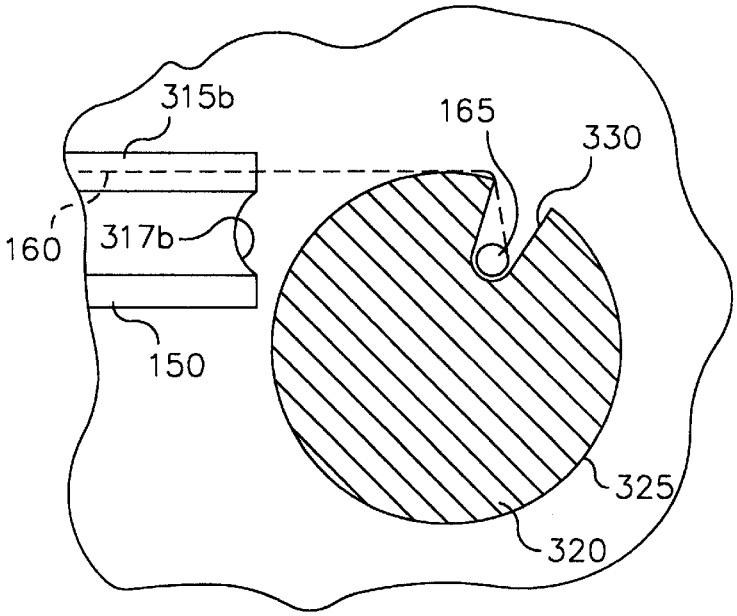
FIG. 4 is a fragmentation view in vertical section of a first configuration take-up spool.
Figure 3:
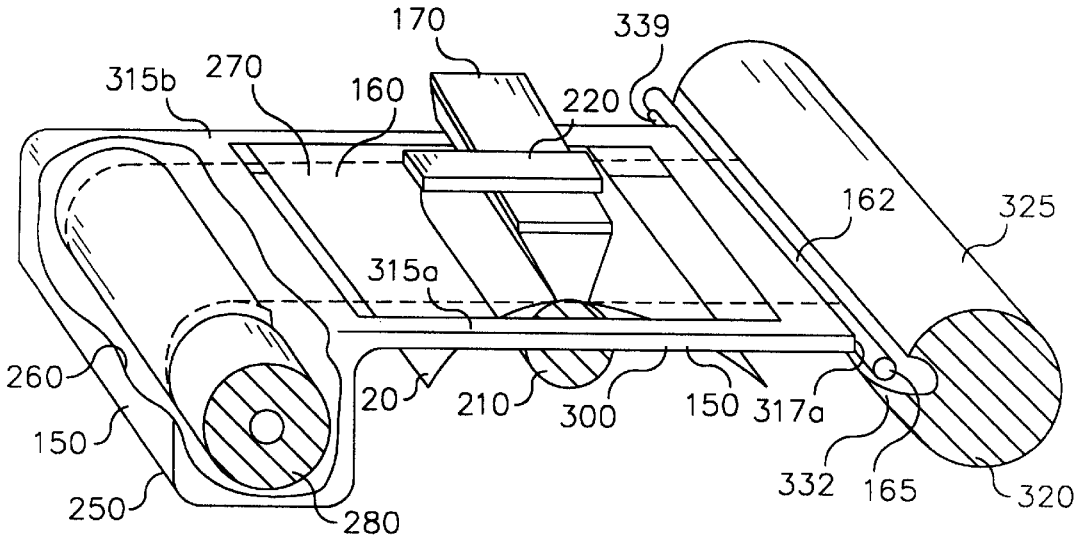
FIG. 3 is a view in perspective and partial section of the cartridge engaging a take-up spool.
Figure 5:
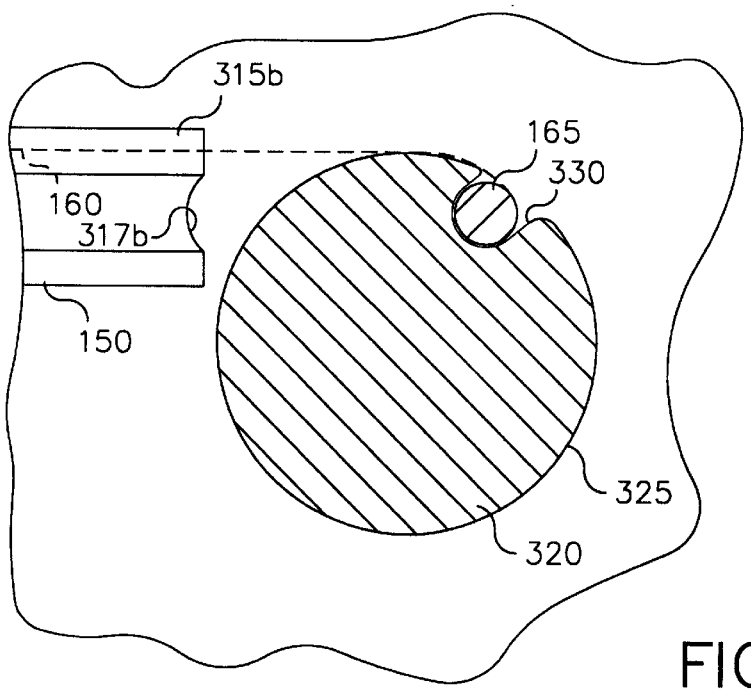
FIG. 5 is a fragmentation view in vertical section of a second configuration take-up spool.

Referring to FIGS. 4 and 5, recess 330 has a predetermined contour. By way of example only, and not by way of limitation, pin 165 may reside in recess 330, so that no portion thereof is exposed beyond exterior surface 325 (see FIG. 4). It is understood that, in this case, an effective radius of the combination of pin 165 and take-up spool 320 remains substantially constant. An advantage of this embodiment of the invention is that it reduces tension variations in dye donor ribbon 160 as take-up spool is rotated, which tension would otherwise occur if any portion of pin 165 extended beyond exterior surface 325 of take-up spool 320. As another example, pin 165 may reside in recess 330, so that the exterior surface of pin 165 is substantially flush with exterior surface 325 of take-up spool 320 (see FIG. 5). An advantage of this latter embodiment of the invention is that it results in a constant effective radius of the take-up spool 320 and pin 165 configuration as dye donor ribbon 160 is wound onto take-up spool 320, thereby causing less mechanical disturbance of both dye donor ribbon 160 and dye receiver 20 when dye receiver 20 is near print head 170.

Returning to FIGS. 1, 2 and 3, it is appreciated that, unlike prior art devices, take-up spool 320 is relatively permanently disposed in housing 90 rather than being integrally attached to cartridge 150. It is important that take-up spool 320 be disposed in housing 90 rather than being integrally attached to cartridge 150. This is important because print head 170 need not be raised a distance to accommodate take-up spool 320; rather, print head 170 need only be raised a minimal distance "d" sufficient to allow relatively thin neck portion 300 to pass through distance "d" in order to provide interference-free clearance for passage of neck portion 300. Such a minimal distance "d" means that angle "α" need not be increased to accommodate passage of both take-up spool 320 as well as neck portion 300. That is, angle "α" is minimized when only neck portion 300 is inserted through clearance "d" to be positioned in nip 200. Minimizing the clearance distance "d" through which print head 170 must be lifted allows print head 170 to be lifted entirely within housing 90, thereby avoiding the need to open top wall 110 of housing 90. Thus, avoiding the need to open top wall 110 of housing 90 results from being able to load cartridge 150 through aperture 140 of front sidewall 120 (rather than loading cartridge 150 through top wall 110) in the manner described. This feature of the present invention allows printer 10 to be disposed in confined space 40 with limited headroom.

As best seen in FIG. 4, once cartridge 150 is interposed between print head 170 and platen 210 in the manner disclosed hereinabove, print head 170 is moved, by any suitable means, to its second position and printing may commence. During the printing operation, in which print head 170 heats dye donor ribbon 160 to transfer dye therefrom onto receiver 20, take-up spool 320 rotates in order to "take-up" dye donor ribbon 160 being unwound from supply spool 280. Pin 165 belonging to dye donor ribbon 160 is received into recess 330 as take-up spool 320 begins "taking-up" ribbon 160.

Figure 6:
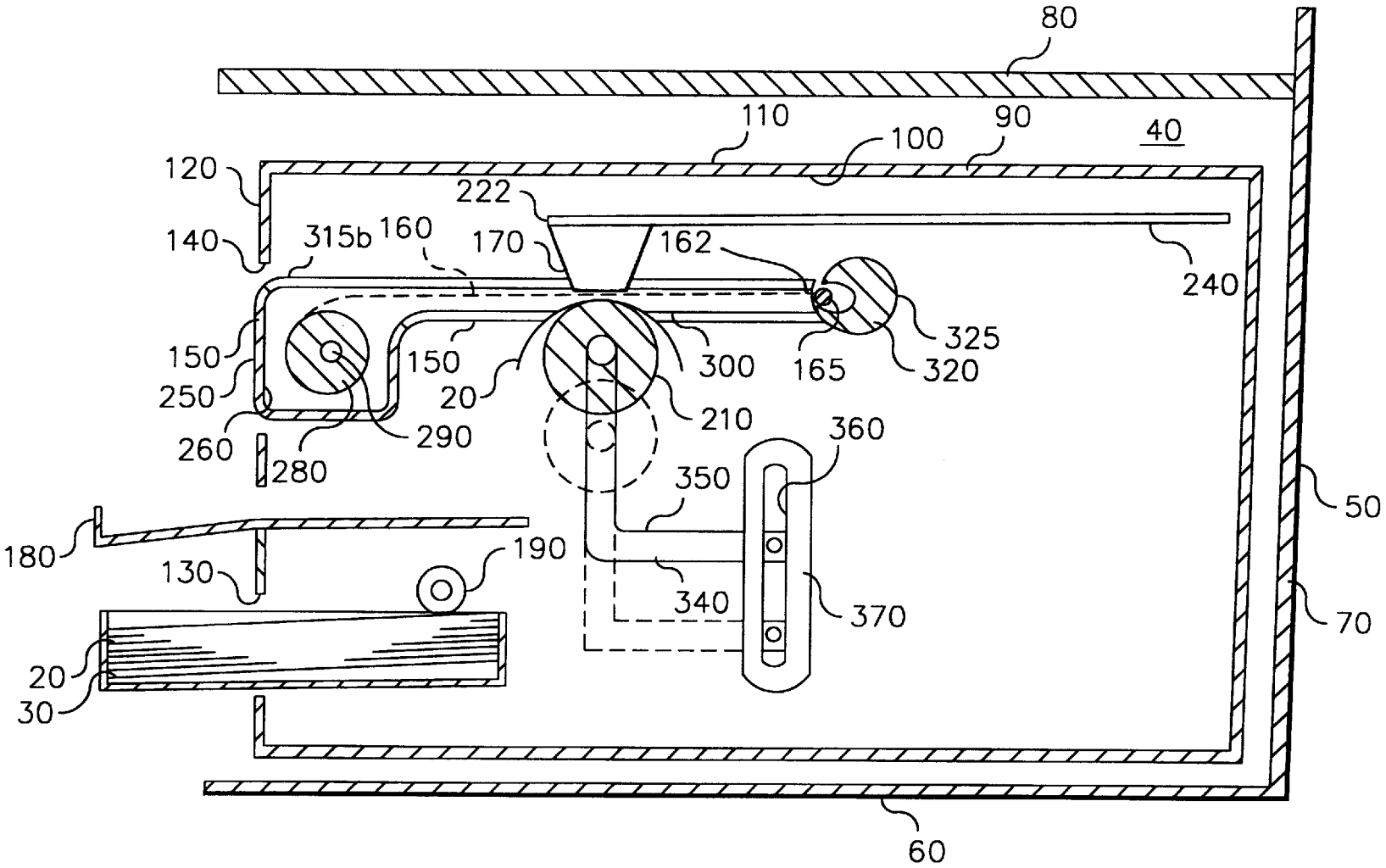
FIG. 6 is a view in elevation of a second embodiment thermal printer with parts removed for clarity.

Referring to FIG. 6, there is shown a second embodiment of printer 10. In this second embodiment of printer 10, platen 210 is movable such as by means of a translation arm 340 having an end portion 350 slidable in a slot 360 defined by a support plate 370 disposed in housing 90. When translation arm 340 moves to a first position thereof spaced-apart from print head 170, it creates the previously mentioned clearance "d" between print head 170 and platen 210. Of course, this clearance "d" is substantially reduced when platen 210 moves to a second position thereof to adjacent to print head 170.

It may be appreciated from the teachings herein that an advantage of the present invention is that printer 10 has a reduced exterior envelope so that it can be disposed in confined space 40 which has limited headroom. This is so because dye donor cartridge 150 can be loaded, interference-free, into housing 90 through aperture 140 in front sidewall 120 rather than by opening a top panel of printer 10.

The invention has been described in detail with particular reference to certain preferred embodiments thereof, but it will be understood that variations and modifications can be effected within the spirit and scope of the invention. For example, supply spool 280 may be disposed relatively permanently with housing 90 and take-up spool 320 may be disposed in chamber 260. That is, unused portions of donor ribbon 160 could be wound on spool 320 while used portions of donor ribbon 160 could be wound onto spool 280, if desired. Thus, in this latter example unused dye donor ribbon 160 is wound on spool 320 and used dye donor ribbon 160 becomes wound on spool 280. The advantage associated with this latter example is that the need for a rewinding step in order to rewind used dye donor ribbon 160 onto spool 320 is eliminated.

Therefore, what is provided is a printer defining a reduced exterior envelope thereof and method of providing same.

PARTS LIST

"α" . . . angle
"d" . . . clearance
10 . . . printer
20 . . . dye receiver
30 . . . receiver medium supply tray
40 . . . confined space
50 . . . shelf structure
60 . . . floor
70 . . . rear wall
80 . . . ceiling
90 . . . housing
100 . . . interior
110 . . . top wall
120 . . . front sidewall
130 . . . opening
140 . . . aperture
150 . . . cartridge
160 . . . ribbon
162 . . . end portion
165 . . . pin
170 . . . print head
180 . . . output tray
190 . . . picker roller
200 . . . nip
210 . . . platen
222 . . . first end portion
225 . . . second end portion
230 . . . joint
240 . . . support member
250 . . . enlarged end portion
260 . . . chamber
270 . . . opening
280 . . . supply spool
290 . . . first axle
300 . . . neck portion
310*a/b* . . . tines
315*a/b* . . . first end portions
320 . . . take-up spool
325 . . . exterior surface
330 . . . recess
332 . . . protuberance
335 . . . center-most axis
337 . . . tangent line
340 . . . translation arm
350 . . . end portion
360 . . . slot
370 . . . support plate

What is claimed is:

1. A printer, comprising:

(a) a housing having an aperture;

(b) a first image forming member disposed in said housing;

(c) a second image forming member associated with said first image forming member and disposed in said housing, said second image forming member being movable from a first position spaced-apart from said first image forming member to a second position adjacent to said first image forming member, said first image forming member and said second image forming member defining a clearance therebetween as said second image forming member is in the first position;

(d) a cartridge insertable through the aperture and into said housing, said cartridge having an elongate neck portion sized to be received through the clearance for interference-free insertion of said cartridge into said housing, said cartridge having a dye ribbon disposed therein having an end portion;

(e) a catch-member attached to the end portion of the dye ribbon; and (f) a spool disposed in said housing, said spool having a recess therein for receiving said catch-member.

2. The printer of claim 1, (a) wherein said first image forming member is a platen; and (b) said second image forming member is a print head.

3. The printer of claim 1, (a) wherein said first image forming member is a print head; and (b) wherein said second image forming member is a platen.

4. A printer, comprising:

(a) a housing having a sidewall having an aperture;

(b) a platen disposed in said housing;

(c) a print head disposed in said housing, said print head being movable from a first position spaced-apart from said platen to a second position adjacent to said platen, said platen and said print head defining a clearance therebetween as said print head is in the first position;

(d) a cartridge insertable through the aperture and into said housing, said cartridge having an elongate neck portion sized to be received through the clearance for interference-free insertion of said cartridge into said housing, said cartridge having a dye ribbon disposed therein having an end portion;

(e) a catch-member attached to the end portion of the dye donor ribbon; and (f) a take-up spool disposed in said housing, said take-up spool having a recess therein for receiving the catch-member.

5. The printer of claim 4, further comprising a supply spool disposed in said cartridge, said supply spool having the dye donor ribbon wound thereabout.

6. The printer of 4, further comprising a movable arm connected to said print head for moving said print head between the first position and the second position thereof.

7. The printer of claim 4, further comprising a catch connected to said take-up spool and engageable with said catch-member for retaining said catch-member in the recess.

8. The printer of claim 4, wherein said print head is a thermal print head.

9. A printer, comprising:

(a) a housing having a sidewall having an aperture, said housing defining an exterior envelope theresurrounding;

(b) a platen disposed in said housing;

(c) a print head disposed in said housing, said print head being movable from a first position spaced-apart from said platen to a second position adjacent to said platen, said platen and said print head defining a clearance therebetween as said print head is in the first position;

(d) a dye cartridge insertable through the aperture and into said housing, said cartridge having an elongate neck portion sized to be received through the clearance for interference-free insertion of said cartridge into said housing, said cartridge including a supply spool for engaging a first end portion of a dye donor ribbon extending through the neck portion; and (e) a take-up spool disposed in said housing and alignable with the neck portion for engaging a second end portion of the dye donor ribbon, said take-up spool having a recess therein;

(f) an elongate pin attached to the second end portion of the dye donor ribbon and receivable in the recess; and (g) a movable arm connected to said print head for moving said print head between the first position and the second position, so that the exterior envelope surrounding said housing is unchanged.

10. The printer of claim 9, further comprising a catch connected to said take-up spool and engageable with said pin for retaining said pin in the recess.

11. The printer of claim 9, wherein said print head is a thermal print head.

12. A method of providing a printer, comprising:

(a) providing a housing having an aperture;

(b) disposing a first image forming member in the housing;

(c) disposing a second image forming member in the housing and near the first image forming member, the second image forming member being movable from a first position spaced-apart from the first image forming member to a second position adjacent to the first image forming member, the first image forming member and the second image forming member defining a clearance therebetween as the second image forming member is in the first position;

(d) providing a cartridge insertable through the aperture and into the housing, the cartridge having an elongate neck portion sized to be received through the clearance for interference-free insertion of the cartridge into the housing, the cartridge having a dye ribbon disposed therein having an end portion;

(e) attaching a catch-member to the end portion of the dye ribbon; and (f) disposing a spool in the housing, the spool having a recess therein for receiving the catch-member.

13. The method of claim 12, (a) wherein the step of disposing a first image forming member comprises the step of disposing a platen; and (b) wherein the step of disposing a second image forming member comprises the step of disposing a print head.

14. The method of claim 12, (a) wherein the step of using a first image forming member comprises the step of using a print head; and (b) wherein the step of disposing a second image forming member comprises the step of disposing a platen.

15. A method of providing a printer, comprising:

(a) using a housing having a sidewall having an aperture;

(b) disposing a platen in the housing;

(c) disposing a print head in the housing, the print head being movable from a first position spaced-apart from the platen to a second position adjacent to the platen, the platen and the print head defining a clearance therebetween as the print head is in the first position;

(d) using a cartridge insertable through the aperture and into the housing, the cartridge having an elongate neck portion sized to be received through the clearance for interference-free insertion of the cartridge into the housing, the cartridge having a dye ribbon disposed therein having an end portion;

(e) using a catch-member attached to the end portion of the dye donor ribbon; and (f) disposing a take-up spool in the housing, the take-up spool having a recess therein for receiving the catch-member.

16. The method of claim 15, further comprising the step of disposing a supply spool in the cartridge, the supply spool having the dye donor ribbon wound thereabout.

17. The method of claim 15, further comprising the step of connecting a movable arm to the print head for moving the print head between the first position and the second position thereof.

18. The method of claim 15, further comprising the step of connecting a catch to the take-up spool and engageable with the catch-member for retaining the catch-member in the recess.

19. The method of claim 15, wherein the step of disposing a print head comprises the step of disposing a thermal print head.

20. A method of providing a printer, comprising:

(a) using a housing having a sidewall having an aperture, the housing defining an exterior envelope there surrounding;

(b) disposing a platen in the housing;

(c) disposing a print head in the housing, the print head being movable from a first position spaced-apart from the platen to a second position adjacent to the platen, the platen and the print head defining a clearance therebetween as the print head is in the first position;

(d) using a dye cartridge insertable through the aperture and into the housing, the cartridge having an elongate neck portion sized to be received through the clearance for interference-free insertion of the cartridge into the housing, the cartridge including a supply spool for engaging a first end portion of a dye donor ribbon extending through the neck portion; and (e) disposing a take-up spool in the housing and alignable with the neck portion for engaging a second end portion of the dye donor ribbon, the take-up spool having a recess therein;

(f) attaching an elongate pin to the second end portion of the dye donor ribbon and receivable in the recess; and (g) connecting a movable arm to the print head for moving the print head between the first position and the second position, so that the exterior envelope surrounding the housing is unchanged.

21. The method of claim 20, further comprising the step of connecting a catch to the take-up spool and engageable with the pin for retaining the pin in the recess.

22. The method of claim 20, wherein the step of disposing a print head comprises the step of disposing a thermal print head.

* * * * *